United States Patent [19]

Beck et al.

[11] Patent Number: 4,684,769

[45] Date of Patent: Aug. 4, 1987

[54] MANUAL CLUTCH SWITCHING SYSTEM

[75] Inventors: Willi K. Beck, Hingham; Lincoln V. Danielson, Seekonk; Andrew Strange, Brockton, all of Mass.

[73] Assignee: Joseph Pollak Corporation, Boston, Mass.

[21] Appl. No.: 904,488

[22] Filed: Sep. 8, 1986

[51] Int. Cl.[4] ..... H01H 3/14

[52] U.S. Cl. ..... 200/61.89; 200/86.5

[58] Field of Search ..... 200/61.89, 61.9, 61.91, 200/86.5, 153 C, 86 R, 61.9

[56] References Cited

U.S. PATENT DOCUMENTS

| | | | |
|---|---|---|---|
| 2,769,043 | 10/1956 | Ulinsky | 200/86.5 X |
| 3,695,379 | 10/1972 | Veilleux | 180/103 |
| 3,766,342 | 10/1973 | Stadelmann | 200/61.89 |
| 4,192,399 | 3/1980 | Otteson et al. | 200/61.89 X |

*Primary Examiner*—A. D. Pellinen
*Assistant Examiner*—Morris Ginsburg
*Attorney, Agent, or Firm*—Kenway & Jenney

[57] ABSTRACT

A switching system operable in response to the travel of a vehicular lever or pedal such as a clutch for opening and closing operating circuits of the vehicle. The system includes actuators for moving switch contacts to change the conditions of the circuits in which they are incorporated and extension arms connected to said actuators through ratchet-and-pawl mechanisms. The extension arms are contacted and moved by an arm of the vehicular lever or pedal against spring bias which returns the actuators to the positions they were in before contact by the pedal arm. The ratchet-and-pawl mechanisms automatically compensate for increases in travel and may be reset for decreases in travel of the lever or pedal.

8 Claims, 2 Drawing Figures

MANUAL CLUTCH SWITCHING SYSTEM

This invention relates in general to a vehicular switching system controlled by a pivoting lever or pedal, and in particular to self-adjusting switches operable in response to travel of such a lever or pedal.

BACKGROUND OF THE INVENTION

In any vehicle there are levers and pedals which control various functions. Often, it is desired to prevent accidental engine starting, vehicular movement or other result when the lever or pedal is moved. In a typical situation involving a vehicle having a standard transmission, a foot-operated clutch is utilized to disengage the engine from the drive train during gear shifting. Obviously, it is also desirable that the drive train be disengaged when the engine of the vehicle is being started. Although the gear lever may be left in neutral to avoid the danger associated with starting an engine during drive gear engagement, a more positive safety mechanism is one in which the clutch must be depressed by the operator before the ignition circuit can be energized. Various start interlock systems have been employed to prevent "starting in gear", but they are generally incapable of adjustment as often needed, complex and relatively expensive.

Similarly, in vehicles equipped with so-called "cruise control" it is desirable that the cruise control mechanism be disabled when gears are shifted. There are no available simple systems for disablement of cruise control in response to manual clutch pedal travel, despite the clear need for such an arrangement. Finally, especially with electronic fuel injection (EFI), it is desirable that the EFI system be actuated as engine starting is initiated, and this function also could advantageously be made responsive to clutch pedal travel. Some mechanisms to perform these functions on an individual basis have been devised, but they are frequently cumbersome, expensive, complicated, and impossible to adjust to meet changing conditions.

It is therefore an object of the present invention to provide a compact switch assembly for vehicular levers and pedals.

It is another object of the present invention to provide self-adjusting switches for start interlock, cruise control and fuel flow in vehicles having standard transmissions.

It is a further object of the present invention to simplify the adjustment and re-setting of manual clutch switches.

A still further object of the present invention is the provision of an assembled switch system ready for installation in a vehicle.

SUMMARY OF THE INVENTION

Generally, the invention resides in the incorporation of several switching systems in a compact housing designed to be mounted adjacent a movable lever or pedal in a vehicle. The invention is widely applicable in such situations, but will be described for ease of understanding in connection with the clutch pedal of a vehicle equipped with a standard manually shifted transmission. Switching is effected by simple spring-biased lever arm contacts between the clutch pedal and the switching system.

The switching system includes two actuators, spring-biased in opposite directions about a point and movable in response to movement of the adjacent clutch pedal. The actuators may be employed to open or close the circuits of any of several operating devices in the vehicle. For example, one actuator may conveniently serve as a starter interlock switching element and the other as a cruise and fuel control element. Operation of the actuators by the clutch pedal is via ratchet-and-pawl arrangements, permitting compensation for changes in clutch travel which is automatic for increased clutch travel and manually resettable for decreased clutch travel.

DESCRIPTION OF PREFERRED EMBODIMENT

Figure 1:
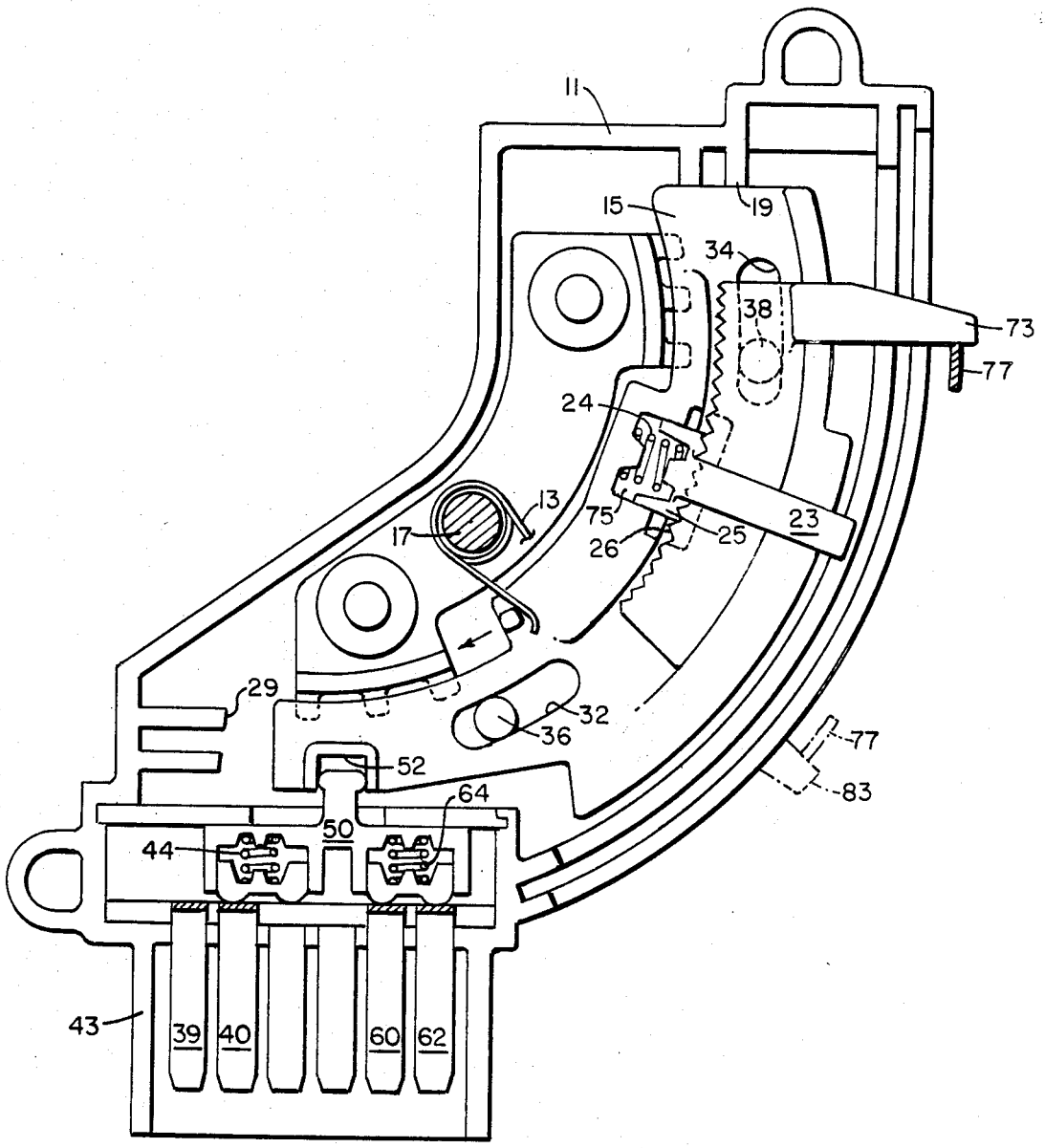
FIG. 1 is a view in section of one side of a manual clutch switch assembly.

In FIG. 1, there is shown a housing 11 which normally is provided with a cover, not shown in this view, to enclose the entire switch assembly except for a slot through which operating arms protrude. The housing 11 may be mounted on the fire wall or the frame of a vehicle adjacent to its clutch pedal by any suitable means such as a mounting bracket. The operational elements include a pair of actuators 15 and 16 biased in opposite directions by a spring 13 mounted upon a post 17. The actuator 16 is not visible in this view, but both the actuators are guided in their arcuate sliding motion by means of actuator slots such as 32 and 34 in which pins 36 and 38 respectively are engaged. The pins 36 and 38 and the post 17 are mounted in fixed position in the housing 11 and the torsion spring 13 is so connected as to urge the actuator 15 in a clockwise direction as shown in FIG. 1. Actuator stops 19 and 29 are formed at opposite ends of the housing 11 to limit travel of the actuator 15.

A first set of fixed working contacts 39 and 40 are disposed in a box enclosure 43 for engagement by a movable contact pair 44. The movable contact pair 44 is held in a carrier yoke having a neck portion 50 which, in turn, is engaged in a rounded slot 52 formed in the lower surface of the actuator 15. A similar second set of fixed working contacts 60 and 62 are also disposed in the enclosure 43 and engageable by a movable contact pair 64. The movable contact pair 64 is also held in the yoke having the neck 50 and both movable contact pairs are slidable over their associated fixed contacts as the actuator 15 moves.

The box enclosure 43 provides protection from dirt, dust and moisture for the enclosed contacts. Only relatively small slotted openings are needed for the yokes to protrude from the enclosure.

A radial extension arm 73 is connected through a ratchet-and-pawl 75 to the actuator 15. The radial extension arm 73 protrudes through a slot in the housing 11 for physical engagement by a switch control arm 77 fixed to the clutch pedal of the vehicle.

In a typical movement, as the manual clutch pedal is depressed from its topmost position, the radial arm 73 follows the switch control arm 77, it being urged with the actuator 15 by the torsion spring 13 in an arcuate path as determined by the slots 32 and 34 and the pins 36 and 38. The movable contact pairs 44 and 64 are moved to the left as the actuator 15 moves roughly clockwise as shown in the drawing. The normally closed cruise control circuit is opened as the movable contact 64 pair moves from bridging the fixed contacts 60 and 62 to a position touching only the contact 60. Simultaneously, movement of the contact pair 44 to the left closes the normally open fuel control circuit by its bridging of the contacts 39 and 40.

Adjacent the slotted opening 52, the actuator 15 terminates in a blunt end. When the clutch pedal is depressed to a point where the arm 73 has moved through some predetermined arbitrary distance, the left lower end of the actuator 15 contacts the stop 29 formed on the housing 11. Further depression of the clutch pedal cannot result in additional travel of the actuator 15, but the movable contact pair 64 remains in position touching only the contact 60, thus holding the cruise control circuit open. Similarly, the movable contact pair 44 remains bridging the contacts 39 and 40, holding the fuel control circuit closed.

Figure 2:
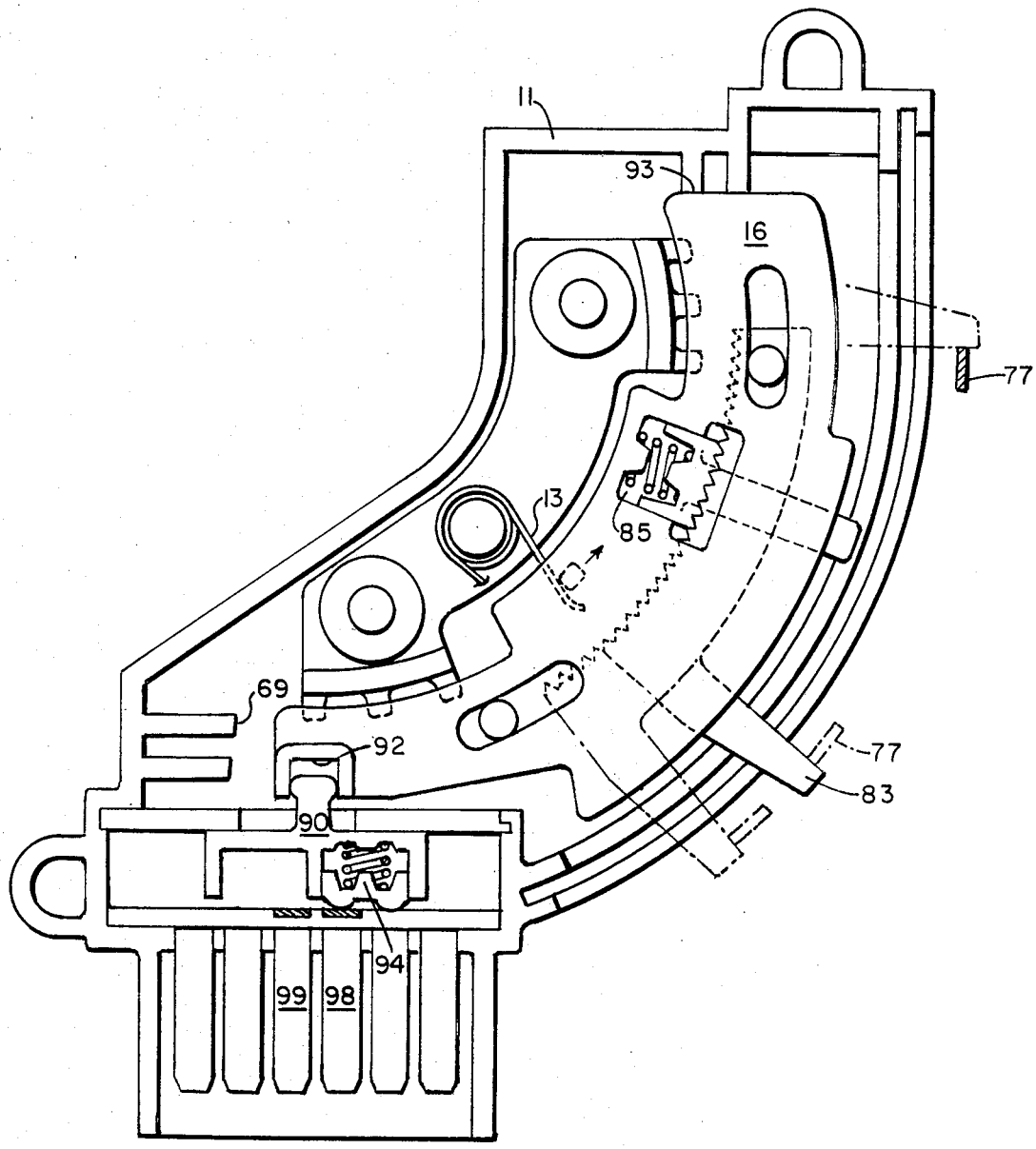
FIG. 2 is a view in section of the opposite side of the assembly of FIG. 1.

As the clutch pedal is still further depressed toward its lowermost point as seen in FIG. 2, the switch control arm 77 strikes a second radial extension arm 83 which is connected through a ratchet-and-pawl 85 to the second actuator 16. The actuator 16 is similar in all relevant respects to the actuator 15 and is biased in a generally counterclockwise direction by the spring 13. It includes a rounded slot 92 engaging a neck 90 of a yoke in which a movable contact pair 94 is retained. As in the case of the actuator 15 and its associated contacts, a box enclosure is provided here as well. The movable contact pair 94 is normally in a position touching only the fixed contact 98, thus holding the starter interlock circuit open. However, at an arbitrarily chosen point from its lowermost position in its clockwise travel, pressure of the switch control arm 77 against the extension arm 83 causes the actuator 16 to be moved against spring bias, carrying the yoke and movable contact pair 94 into a position bridging the contacts 98 and 99 to close the start interlock circuit.

As the clutch pedal is released to return to its normal position, the radial extension arm 83 follows the switch control arm 77 and the actuator 16 is urged in a counterclockwise direction by the torsion spring 13, opening the starter interlock circuit as the movable contact pair 94 resumes its normal position touching only the fixed contact 98. At this time, the actuator 16 contacts a stop 93 formed in the housing 11 and moves no further counterclockwise, the starter interlock circuit continuing to be held in its normally open condition. Continuing movement upward of the switch control arm 77 with clutch travel causes that arm to contact the radial extension arm 73 at an arbitrarily chosen point near its topmost excursion. The actuator 15 is again involved and then carries the movable contact pairs 44 and 64 to the right as seen in FIG. 1, closing the cruise control circuit and opening the fuel control circuit. These contacts will remain so positioned until the clutch pedal is again depressed.

The ratchet-and-pawl assemblies 75 and 85 associated with the actuators 15 and 16, respectively, provide self-adjusting and reset features which compensate for changes in clutch travel. In the usual situation where clutch travel increases with use and wear, self-adjustment occurs. Considering the case when the clutch is released for the first time after the installation of the switch of the invention, the switch control arm 77 will contact the radial extension arm 73 of the actuator 15 as it approaches its furthest upward point of travel. The radial extension arm 73 will then move the actuator 15 in a counterclockwise direction closing the cruise control circuit and opening the fuel control circuit, a resumption of their normal condition. Further upward movement of the switch control arm 77 and the radial extension arm 73 causes no further movement of the actuator 15 because it is in contact with the stop 19. However, the radial extension arm 73 will then override its pawl 75 and continue moving relative to the actuator 15 to the upper limit of clutch pedal travel as is suggested in the phantom showing of the arms at the upper left of FIG. 1.

Similarly, when the clutch is first depressed, the switch control arm 77 physically contacts and moves the radial extension arm 83 and the latter moves the actuator 16 in a clockwise direction until the actuator 16 meets the stop 69. At this point, the starter interlock circuit is closed and remains closed, but the extension arm 83 is permitted by its ratchet and pawl 85 to continue to move relative to the actuator 16 to the lowermost limit position of clutch pedal travel as is suggested in the phantom showing of the arms at the lower center of FIG. 1. The radial extension arms 73 and 83 will remain in the same positions relative to the actuators 15 and 16 respectively until increased clutch travel must be accommodated. At that time, they will automatically override their respective ratchet-and-pawl systems to assume appropriate new positions.

Each ratchet-and-pawl system is provided with a pawl release plunger typified by the plunger 23. A spring 24 urges the pawl teeth 25 into engagement with the teeth 26 of the actuator 15. Pressing in on the release plunger 23 disengages the teeth and permits the radial extension arm 73 to be manually reset relative to the actuator 15 to the minimum travel position.

In a typical installation, any reasonable increases in clutch travel in an upward direction will be accommodated by the overtravel of the radial extension arm relative to the actuator. A similar range of travel increase in the downward direction will also be accommodated. At the original installation of the switch, it is set for minimum clutch travel and will reset itself in the manner described for actual clutch travel that is greater than the minimum. As noted above, however, decreases in clutch travel must be compensated for by pressing the pawl release plunger and manually moving the radial extension arm to the minimum position.

The disclosed embodiment of the invention relates to certain specific switching functions, but other operations responsive to vehicular pedal or lever travel might equally well be controlled by practicing the invention. Accordingly, the scope of the invention should be limited only by the appended claims.

What is claimed is:

1. In a switching system for a vehicle, the combination of a clutch having a movable pedal, a plurality of actuators for opening and closing circuits of operating devices in said vehicle, a housing, means for mounting at least two of said actuators for movement in said housing in response to predetermined movement of said pedal, a spring for urging said at least two actuators in opposite directions in said housing, a radial extension arm connected to each of said two actuators, and a control arm connected to said pedal, said control arm being in operative contact with one of said radial extension arms during one fraction of said predetermined movement of said pedal and in operative contact with another of said radial extension arms during another fraction of said predetermined movement of said pedal whereby at least one of said circuits is held open and at least another of said circuits is held closed during said fractions of said predetermined movement.

2. In a switching system as defined in claim 1, the combination in which a ratchet and pawl is interposed between each of said radial extension arms and its associated actuator, each said ratchet-and-pawl permitting limited movement in a given direction of each said radial extension arm relative to its associated actuator.

3. In a switching system as defined in claim 2, the combination in which each said ratchet-and-pawl includes a release plunger operable to disconnect said radial extension arm from its said associated actuator whereby the disposition of each said radial extension arm relative to its said associated actuator may be reset.

4. In a switching system as defined in claim 3, the combination which includes fixed electrical contacts mounted adjacent each of said actuators, said fixed contacts being incorporated in each of said circuits, movable contacts disposed for movement relative to said fixed contacts and means linking said movable contacts with said actuators for moving said movable contacts relative to said fixed contacts in response to movement of said actuators.

5. In a switching system as defined in claim 1, the combination wherein movement of said clutch pedal in response to depression thereof, said one of said circuits is a starter interlock circuit and said predetermined fraction of the movement of one of said actuators takes place before said clutch is fully depressed.

6. In a switching system as defined in claim 2, the combination wherein said movement of said clutch pedal is fixed at a predetermined amount and each said ratchet-and-pawl permits movement of its associated radial arm relative to its associated actuator in response to movement of said clutch pedal in excess of said predetermined amount.

7. In a switching system as defined in claim 6, the combination in which said movement of said clutch pedal in excess of said predetermined amount takes place adjacent the limits of said clutch pedal movement.

8. In a switching system as defined in claim 4, the combination which includes a box enclosure, said fixed and movable contacts being disposed in said box enclosure.

* * * * *